US005482400A

United States Patent [19]

Bavington

[11] Patent Number: 5,482,400

[45] Date of Patent: Jan. 9, 1996

[54] SEGMENTED ADJUSTMENT RISER

[75] Inventor: Gregory F. Bavington, Toronto, Canada

[73] Assignee: National Rubber Technology Inc., Toronto, Canada

[21] Appl. No.: 316,471

[22] Filed: Oct. 3, 1994

[51] Int. Cl.[6] ..... E02D 29/00

[52] U.S. Cl. ..... 404/25; 404/26

[58] Field of Search ..... 404/25, 26; 474/95–98; 52/19–21

[56] References Cited

U.S. PATENT DOCUMENTS

| | | | |
|---|---|---|---|
| Re. 34,550 | 2/1994 | Bowman | 404/26 |
| 4,187,647 | 2/1980 | Hall | 52/20 |
| 4,473,024 | 9/1984 | Armstrong | 114/111 |
| 4,582,450 | 4/1986 | Neil | 404/26 |
| 4,759,656 | 7/1988 | Wilson | 404/26 |
| 4,867,601 | 9/1989 | Bowman | 404/26 |
| 5,030,030 | 7/1991 | Simmonds | 404/25 |
| 5,149,109 | 9/1992 | Jelinek et al. | 277/199 |
| 5,158,505 | 10/1992 | Woyach | 474/98 X |
| 5,281,046 | 1/1994 | Svirklye | 404/26 |
| 5,316,522 | 5/1994 | Carbone et al. | 474/95 |

*Primary Examiner*—Michael Powell Buiz
*Attorney, Agent, or Firm*—Ridout & Maybee

[57] ABSTRACT

A segmented adjustment riser for maintenance holes has a plurality of similar elongated one-piece segments. Each segment has two opposite ends provided with respective interengaging formations, and the segments are placed together end to end to form an endless riser member having planar upper and lower sides. The formations interengage and resist lateral displacement of each end of each segment relative to the adjacent end of each adjacent segment. The segments can be manufactured relatively easily and with greater economy than the corresponding one-piece riser member and facilitate handling and installation.

12 Claims, 3 Drawing Sheets

SEGMENTED ADJUSTMENT RISER

The present invention relates to improvements in adjustment risers for maintenance holes.

Usually, a maintenance hole in a road surface consists of an underground vault or chimney which supports on its upper end a rigid frame, usually of cast iron, the upper edge of which is desirably flush with the road surface. The frame supports a cover such as a maintenance hole cover or valve chamber cover or the like, or a grating, such as a catch basin grating. On various occasions, it may be necessary to adjust the position of the frame relative to the vault or chimney, for example during the construction of the maintenance hole or in the course of repairing the road surface, in order to ensure that the upper edge of the frame is maintained flush with the road surface. It is known to use concrete riser members which are interposed between the upper edge of the chimney or vault and the frame in order to elevate the frame relative to the chimney and position the frame at the desired level. The concrete rings are heavy and difficult to manipulate and install, and are prone to cracking or breakage if jarred or dropped.

These difficulties have been mitigated to some extent by using molded elastomeric adjustment rings, for example as disclosed in Wilson U.S. Pat. No. 4,759,656. However, the elastomeric rings are more difficult and more expensive to manufacture than is desirable, especially in the case of large diameter rings, because of the large capacity molding equipment that has to be employed. Further, they tend to be heavier than is considered desirable and therefore still provide some difficulty in manipulation and installation.

In accordance with the present invention, there is provided a segmented adjustment riser comprising a plurality of similar elongated one-piece segments. Each segment has its opposite ends provided with respective interengaging formations. The segments are placed together end to end to form an endless riser member which has planar upper and lower sides. The formations interengage and resist lateral displacement of each end of each segment relative to the adjacent end of each adjacent segment.

The segments are considerably simple to manufacture, and can be manufactured with considerable economy as compared with a one-piece riser member, since the segments may, for example, be formed in relatively small molds. Preferably, the segments forming the completed riser are each identical to one another. Further, the segments are considerably lighter in weight than the corresponding one-piece riser member, and therefore can be carried, manipulated and installed much more easily than the known one-piece riser members.

The invention and further advantages thereof will now be more fully described with reference to the accompanying drawings, in which.

Figure 1:
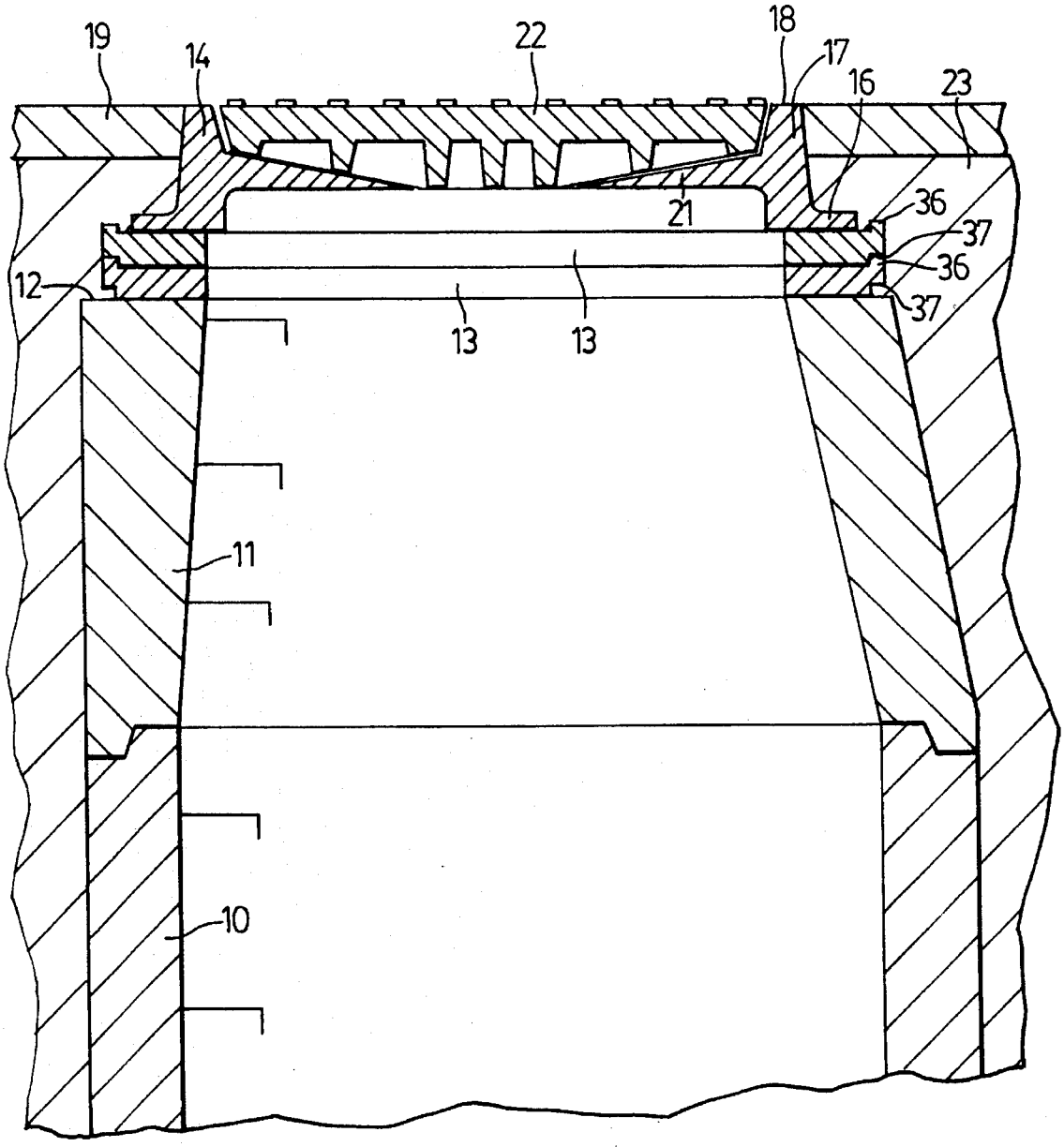
FIG. 1 is a vertical cross section through a maintenance hole structure comprising riser members in accordance with the invention.

FIG. 1 shows a cross section of a typical maintenance hole, comprising a cylindrical concrete riser section 10 supporting a generally conical concrete section 11 which tapers upwardly toward a planar annular surface 12.

Supported on the surface 12 are a plurality, in this case two, riser members 13 in accordance with the invention, each having a planar upper and lower surface. On the planar upper surface of the upper adjustment riser member 13 is supported a generally circular frame member 14 having an annular base flange 16 which seats on an upper planar surface of the upper adjustment riser 13. The frame 14 comprises a generally cylindrical sidewall 17 having a planar upper surface 18, which is desirably flush with the surface of asphalt paving material 19 forming a road surface.

The inner side of the sidewall 17 has an inwardly projecting flange 21 on which seats a circular maintenance hole cover 22.

The excavation in which the risers 10 and 11 are placed is filled with granular backfill 23 which also forms a substratum to the paving material 19.

As will be appreciated from FIG. 1, in use, either in the course of construction of the maintenance hole structure, or in the course of repair of the road surface, a number of adjustment risers 13 may be stacked on the upper surface 12 of the chimney structure, in order to adjust the height of the frame 14, so that, in the finished construction, the upper edge 18 of the frame and the cover 22 are flush with the level intended for the paving material surface 19.

Figure 2:
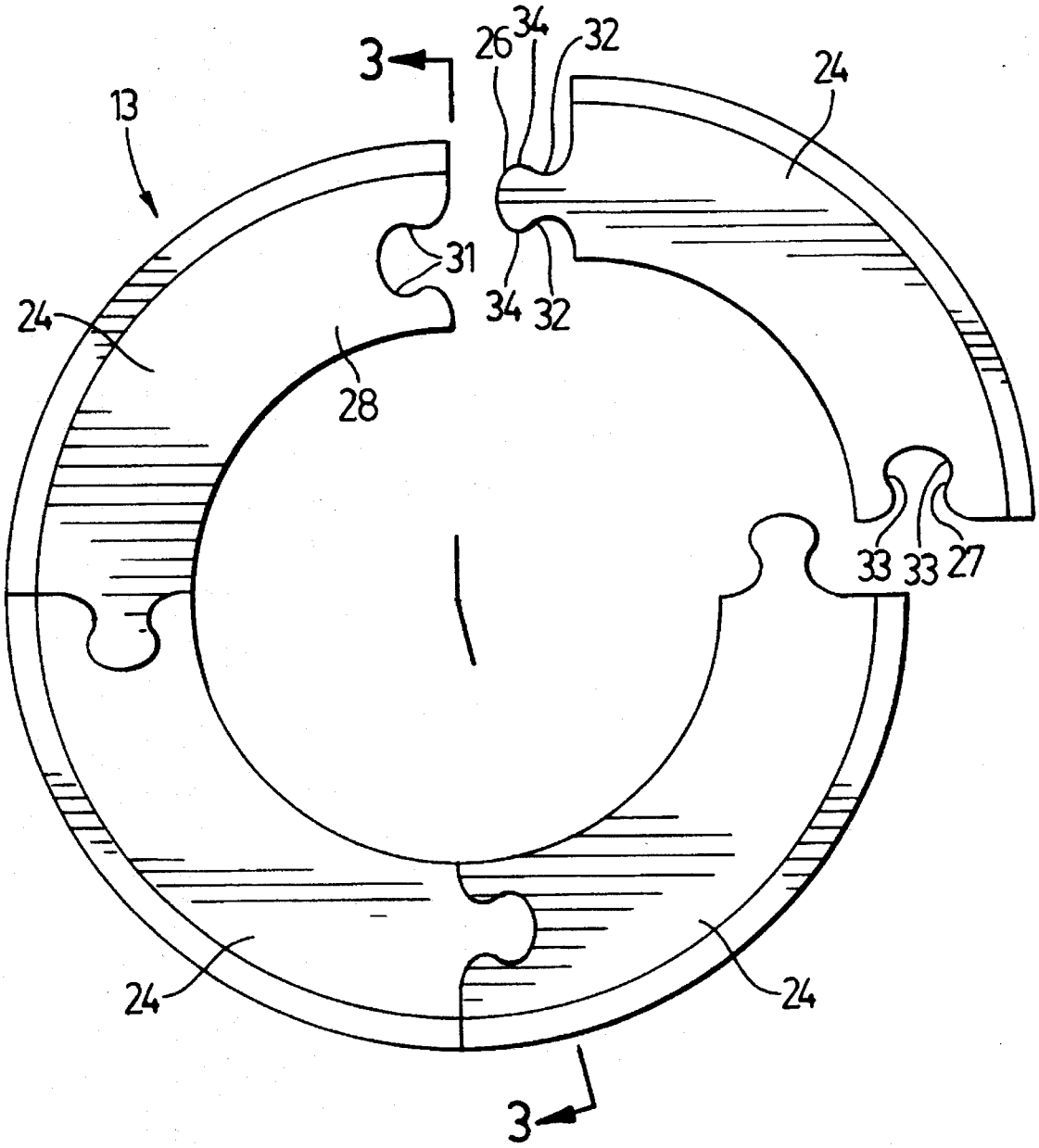
FIG. 2 is a plan view of a riser member in accordance with the invention partly disassembled.
Figure 3:
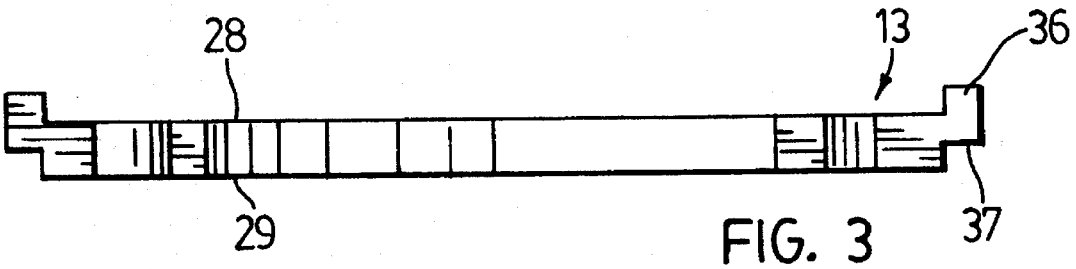
FIG. 3 is a transverse cross section taken on the line 3—3 of FIG. 2.

Referring to FIGS. 2 and 3, showing one of the riser members 13 in more detail, the annular riser member 13 is formed in this example from four identical segments 24. Each segment 24 is formed with corresponding male and female formations 26 and 27 at opposite ends. In the assembled adjustment member, the segments are placed together end to end with the formation 26 of each segment engaging the corresponding formation 27 of the adjacent segment 24, and form an endless riser member, in this case an annular riser member having a planar upper side 28 and a planar lower side 29.

The interengaging formations 26 and 27 cooperate together to resist not only lateral displacement of the end of one segment 24 relative to the adjacent end of the adjacent segment 24, but preferably also to resist longitudinal separation of the adjoining segments in a direction circumferentially of the endless adjustment member. In its assembled condition, therefore, the adjustment member is well able to withstand lateral pressures such as may be imposed upon it by the granular backfill material 23 which is packed around the riser construction.

In the example illustrated, the generally part circular female formations 27 have surfaces 31 facing generally forwardly towards the segment 24 in which they are formed, while the male formations 26 each have surfaces 32 facing generally rearwardly toward their segment 24, these faces engaging in the completed riser member to resist longitudinal separation of adjacent segments in a direction generally circumferentially of the endless riser member. Further, each female formation 27 has laterally opposing inner abutment surfaces 33 while each male formation has laterally outer engagement surfaces 34 that cooperate with the surfaces 33 in the completed riser member to resist lateral or radial displacement of a segment 24 relative to an adjacent segment.

Further, as seen in FIGS. 2 and 3, each segment 24 is provided with a raised rim 36 extending along the outer edge of one side, providing an element offset upwardly with respect to the plane 28, and, in register therewith, the lower side of each segment is provided with a rabbet 37 providing a surface offset upwardly from the lower planar surface 29, so that the rabbet 37 of an upper riser member 13, as seen in FIG. 1 receives the raised rim 36 of a lower adjacent riser member 13, so that lateral slippage or displacement of one riser adjustment member 13 relative to an adjacent riser adjustment member 13 is prevented.

In the example shown in FIGS. 1 to 3, each of the side surfaces of each segment 24 is substantially vertical, and the segments can be assembled to form an endless riser adjustment member by vertically aligning the male and female formations 26 and 27 and allowing the formation 26 to slide vertically into the cooperating formation 27.

The segments 24 may be formed from any material that will provide the segments with sufficient strength properties to support the loads, impacts and other stresses to which the riser members are subjected in service. For example, they may be molded from polymeric material such as a thermoplastic, an elastomer, a mixture of thermoplastic and elastomer, or a thermosetting resin. Examples of thermoplastics include polyethylene, ethylene copolymers and mixtures thereof. Desirably, the polymeric material has hardness so that it does not deform excessively under load, and sufficiently high impact strength, especially at low temperatures, so that it will not fracture as a result of impacts resulting from vehicles running over the maintenance hole in service, or impacts resulting from accidental dropping or mishandling of the segments during installation.

Examples of suitable thermoplastic, elastomeric and thermosetting polymers are well known to those of ordinary skill in the art, as are methods suitable for molding or otherwise forming the segments from such polymers, and need not be described in detail herein. In one preferred form, the segments are vulcanized rubber moldings formed by compression molding of a granular rubber molding compound under heat and pressure in generally trough-shaped molds. The molding compound may contain substantial quantities of recycled rubber obtained by the grinding of waste vulcanized rubber articles, for example, road vehicle tires.

The adjustment riser member formed of polymeric materials, such as rubber, having good hardness, impact strengths and resiliency, provide the advantages that they are able to withstand repeated impacts caused by heavy vehicle tires driving over them without being liable to breakage and failure, and also serve to absorb traffic loads, and reduce the transmission of such loads to subterranean structures such as sewer systems to which the chimney riser members 10 and 11 may be connected. They also provide resistance to or mitigation of movements of maintenance hole frames and associated structure due freeze-thaw cycles.

The riser member segments can be and preferably are molded with smooth edges that are not likely to cut or abrade the hands of workers handling the segments. Further, the polymeric molded segment may and preferably are molded in relatively thin sections, for example, in thicknesses down to about ½ inch, whereas the known concrete riser elements have to be cast to a thickness of at least 2 inches, and would tend to break under their own weight if molded substantially thinner. The polymeric molded items therefore provide greater freedom of design of the adjustment riser member, allowing the members to be molded in a wide range of thicknesses. For example, segments corresponding to a range of standard thicknesses of adjustment risers may be provided, allowing for much greater precision in the adjustment of the level of the maintenance hole frame 14 or the like.

Further, the segments may be formed generally tapering with upper and lower faces inclining relative to one another, so that a set of them can be assembled to form a wedge section endless riser member, such riser member having an upper face inclining relative to the lower side. Such wedge section member may be used, for example, for seating a maintenance hole frame on a horizontal upper end of a vertical chimney, vault or other riser section, at an inclination to the horizontal so that the upper rim of the frame is flush with an inclined road surface.

The structure of the invention may be modified by using segments such that fewer or greater than four are required to form a complete endless riser member. For example, instead of using four segments 24 each subtending an angle of 90° six segments each subtending an angle of 60° could be employed, particularly in the case of segments intended to form annular riser members of especially large diameter.

Moreover, the segments may fit together to form endless figures other than a circle. For example, the segments may be designed to fit together to form oval or other continuously curved endless figures in order to match and support the base flanges of oval or other non-circular maintenance hole frames.

Figure 4:
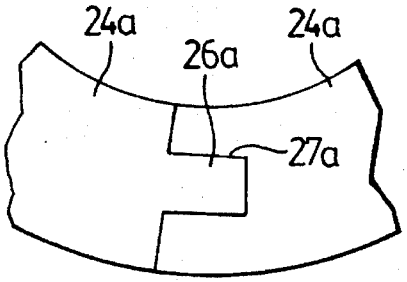
FIG. 4 shows a modified form of interengagement between segments in accordance with the invention.

Other interengaging formations capable of resisting lateral displacement of adjacent segments may be employed. For example, FIG. 4 shows a modified form wherein each segment **24*a* is provided at opposing ends with a generally rectangular formation of a tongue 26*a* and groove 27*a*. This resists relative lateral displacement of the adjacent segments 24*a***, but has less resistance to longitudinal separation of the segments generally in a direction circumferentially of the endless riser member. Other arrangements may, of course, be employed.

Figure 5:
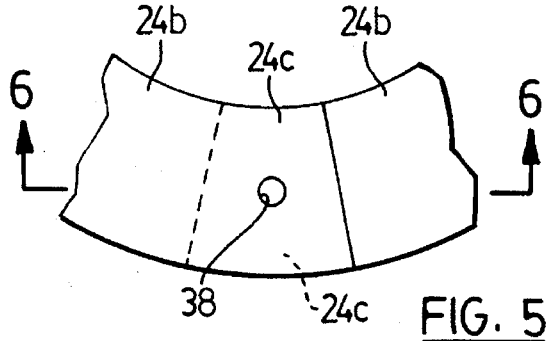
FIG. 5 is a plan view of a further modified form of interengaging formation in accordance with the invention.
Figure 6:
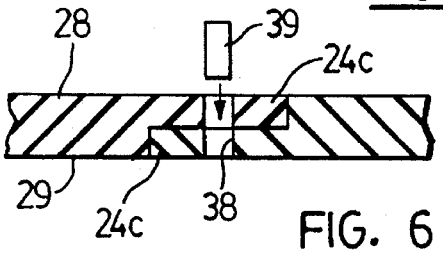
FIG. 6 is a vertical cross section taken on the line 6—6 in FIG. 5.

FIGS. 5 and 6 show a further alternative wherein each segment **24*b* is formed with an end portion 24*c* of reduced thickness. Each of the portions 24*c* has a circular opening 38 through it, and a pin 39, for example a cylindrical pin molded of relatively rigid nylon or the like is driven tightly through the openings 38 in order to anchor the overlapping end portions 24*c*** together.

Figure 7:
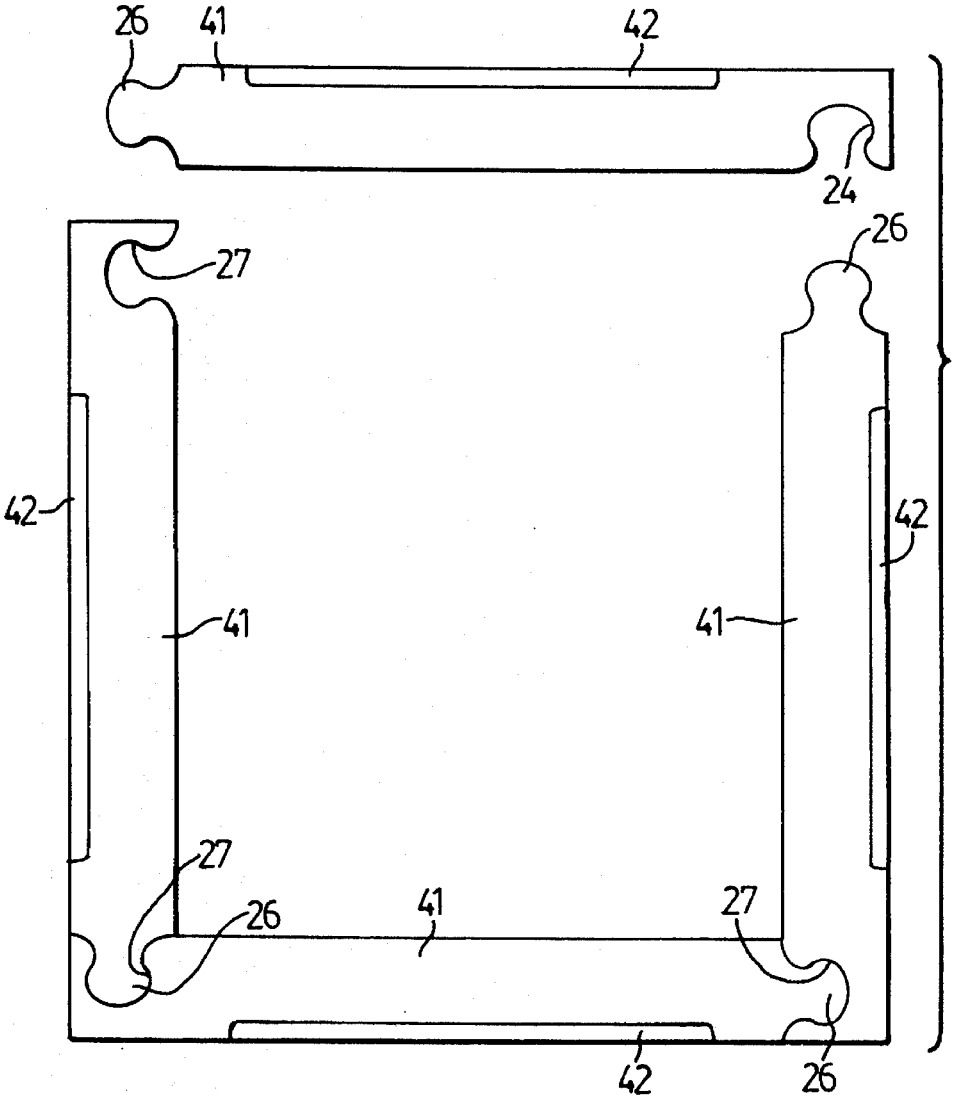
FIG. 7 shows a further modified form of segmented riser in accordance with the invention.

In other forms, the segments may be linear, and are adapted to be interengaged end to end to form a polygonal endless riser member. For example, the completed riser member may be square or rectangular to support the base flange of a square or rectangular maintenance hole frame. FIG. 7 shows, for example, four identical generally linear segments 41 each provided at one end with a formation 26 similar to those described above with reference to FIGS. 2 and 3, and a recess 27 similar to the recesses described above with reference to FIGS. 2 and 3 on a side adjacent each opposite end, so that the segments are adapted to be joined together to form a generally square riser member. Each segment 41 may be provided along one edge With a raised marginal portion 42 and have a corresponding recess on its underside in register with the marginal portions 42 to receive the raised portions of a similar riser member in a vertical assembly, the raised portions and recesses interengaging to resist lateral slippage in a fashion similar to the raised rims 36 and rabbet-like recesses 37 referred to above in connection with FIGS. 2 and 3.

In the preferred form of the segmented riser of the invention, each of the segments is identical, in order to facilitate manufacture and matching of the segment element in sets together to form completed riser members. The segments can be advantageously molded using multiple cavity molds so that a plurality of the identical segments are formed in each molding cycle. It is, however, contemplated that each completed riser member may be formed from a plurality of similar non-identical segments. For example, the circular riser element illustrated in FIGS. 2 and 3 may be formed from two identical quarter segments 24 and one semicircular segment having a formation 26 at one end and a formation 27 at the opposite end.

I claim:

1. In a supporting structure for supporting a maintenance hole frame, an underground vault structure defining an endless planar upper face, an endless adjustment riser member supported on said vault structure and having a planar lower side for bearing on the said upper face, and having a planar upper side, and a maintenance hole frame supported on said adjustment riser member and having a base flange defining a planar lower face for bearing on said planar upper side of said riser mender, wherein the improvement comprises said adjustment riser member comprising a segmented member comprising a plurality of similar elongated one-piece segments, each molded from resilient polymeric material, and each having two opposite ends provided with respective interengaging formations, and placed together end to end to form an endless riser member having planar upper and lower sides, said formations interengaging and resisting lateral and longitudinal displacement of each end of each segment relative to the adjacent end of each adjacent segment.

2. The improvement as claimed in claim 1, wherein said segments are each identical.

3. The improvement as claimed in claim 1, wherein each end of each segment comprises an end portion having an opening therethrough and of reduced thickness as compared with an intervening portion of said segment, said reduced thickness end portions overlapping with said openings in register, and including a pin passing through said openings and retaining said end portions in interengagement.

4. The improvement as claimed in claim 1, wherein said polymeric material comprises vulcanized rubber.

5. The improvement as claimed in claim 1, wherein said segments are arcuate and said riser member defines an endless curve.

6. The improvement as claimed in claim 5, wherein said curve is a circle.

7. The improvement as claimed in claim 1, wherein said segments are linear and said riser member is a square or rectangle.

8. The improvement as claimed in claim 1, wherein each segment has one end having a recess having laterally opposing inner abutment surfaces and an opposite end having a projection received in said recess of an adjacent segment and having laterally outer engagement surfaces engaging said abutment surfaces.

9. The improvement as claimed in claim 1, wherein each segment has one end having a recess having a surface facing generally forwardly toward said segment and an opposite end having a projection having a surface facing generally rearwardly toward said segment, said surfaces of adjacent segments engaging and resisting generally longitudinal displacement of said segments relative to one another.

10. The improvement as claimed in claim 1, wherein one of said planar upper and lower sides has a first element offset in one direction from the plane thereof and the other of said sides a second element offset in said one direction therefrom and in register with said first element and engaging therewith when two of said endless riser members are superimposed, and resisting lateral displacement of said riser members relative to one another.

11. The improvement as claimed in claim 10, wherein said first element comprises a raised rim, and the second element comprises a rabbet adapted to receive said raised rim.

12. The improvement as claimed in claim 11, wherein said rim and rabbet extend along opposed laterally outer edges of each segment.

* * * * *